US005983666A

United States Patent [19]

Straub et al.

[11] Patent Number: 5,983,666

[45] Date of Patent: Nov. 16, 1999

[54] AIR SEPARATION PLANT AND METHOD OF FABRICATION

[75] Inventors: Joseph Straub, North Haledon; Anish Mehta, Somerset; Karl O. Toppel, Flemington, all of N.J.

[73] Assignee: The BOC Group, Inc., New Providence, N.J.

[21] Appl. No.: 08/958,239

[22] Filed: Oct. 27, 1997

[51] Int. Cl.[6] ..... F25J 3/00

[52] U.S. Cl. ..... 62/643; 62/903; 62/906

[58] Field of Search ..... 62/643, 903, 905, 62/906, 924

[56] References Cited

U.S. PATENT DOCUMENTS 3,402,105 9/1968 Sze ..... 62/906
5,237,823 8/1993 Cheung et al. ..... 62/905
5,412,954 5/1995 Grenier ..... 62/905
5,461,871 10/1995 Bracque et al. ..... 62/643
5,617,742 4/1997 Toppel ..... 62/643

*Primary Examiner*—Ronald Capossela
*Attorney, Agent, or Firm*—David M. Roseblum; Salvatore P. Pace

[57] ABSTRACT

An air separation plant having prefabricated heat exchanger and distillation column sections. The heat exchanger can be used in air expansion, waste expansion and product expansion plants by simply connecting the appropriate piping to the heat exchanger. The air separation unit is built up of standardized sections preferably utilizing structured packing. Simplified liquid distributors and supports are used in order to distribute liquid to the packing and to support the packing within the column, respectfully.

11 Claims, 4 Drawing Sheets

AIR SEPARATION PLANT AND METHOD OF FABRICATION

BACKGROUND OF THE INVENTION

The present invention relates to an air separation plant and to a method of fabrication in which a main heat exchanger is designed to function in air expansion, waste expansion and nitrogen expansion plants. Even more particularly, the present invention relates to such an air separation plant and method in which distillation is conducted by mass transfer elements such as packings that are contained within prefabricated column elements.

Air is separated into its components within air separation plants having a main heat exchanger to cool compressed and purified air to a temperature suitable for its distillation and an air separation unit formed by single and double distillation column arrangements. In a double column air separation unit, higher and lower pressure columns are operatively associated with one another in a heat transfer relationship by a condenser-reboiler. The air is distilled in the higher pressure column to separate nitrogen from the air and to produce an oxygen enriched liquid column bottoms which is further refined in the lower pressure column to produce nitrogen and oxygen products. In single column air separation units, the air is separated to produce a nitrogen product as a tower overhead. The liquid column bottoms, enriched in oxygen, is expanded to a low pressure (and therefore a low temperature) to serve as a coolant to condense reflux.

In any air separation plant functioning at cryogenic temperatures there are warm end heat losses and heat leakage into the plant. In order to compensate for such effects, refrigeration can be provided by either expanding part of the incoming air, a waste stream, or part of a product stream. Such expansion produces a refrigerant stream. In case of air expansion, such refrigerant stream is typically introduced in a column. Refrigerant streams originating from waste and product expansions are fed into the main heat exchanger and then fully warmed.

The fabrication of air separation plants involves to a large extent the custom design and construction of its components. For instance, in order for the main heat exchanger to function in an air expansion plant, an intermediate outlet for the air must be provided so that the air is partially cooled prior to its introduction into the expansion engine. In a plant that function with waste or product expansion, such intermediate outlet for the air might not be needed. However, an intermediate outlet for the waste or product stream to be expanded must be provided so that the particular process stream to be expanded is partly warmed. Columns are also custom built, precision components that must have a sufficient height to provide the number of stages of separation that are needed for the particular distillation involved. All of such custom design and construction adds to the capital costs involved in the fabrication of the air separation plant.

As will be discussed, the present invention provides an air separation plant that can be constructed with prefabricated components to eliminate the added capital cost involved in custom design and construction of the components making up the air separation plant.

SUMMARY OF THE INVENTION

The present invention provides an air separation plant comprising an air separation unit, an expansion machine and a main heat exchanger. The air separation unit has at least one distillation column to separate air into oxygen-rich and nitrogen-rich components and to produce at least two process streams composed of the oxygen and nitrogen-rich components. The expansion machine produces a refrigerant stream to refrigerate the air separation plant. The main heat exchanger has an air expansion passage to produce a partially cooled air stream, an air liquefaction passage branching from the air expansion passage to produce a liquefied air stream, at least two process stream passages, each sized to accommodate the at least two process streams both at column pressure and at a reduced pressure of the refrigerant stream. Additionally provided is a process stream expansion passage configured to partially warm one of the at least two process streams. The air expansion passages are connected to the expansion machine and the expansion machine is connected to the air separation unit such that the resultant refrigerant stream is introduced into the air separation unit. The main heat exchanger is connected to the air separation unit to receive the at least two process streams within the at least two process stream passages and to introduce the liquefied air stream into the air separation unit. Additionally, the main heat exchanger is connected to the air separation unit such that the process stream expansion passage is unconnected and thus not utilized.

In another aspect, the present invention provides an air separation plant in which the main heat exchanger is connected to the air separation unit in a manner that is different than that outlined above. In this aspect of the present invention, the main heat exchanger is connected to the air separation unit so that one of the at least two process streams are received within the process stream expansion passage and another of the at least two process streams is received within one of the at least two process stream passages. The partially cooled air stream is introduced into an air separation unit and the air liquefaction passage is unconnected and therefore not utilized. The expansion machine is connected to the main heat exchanger to receive the one of the two process streams after having been partly warmed and so that the refrigerant stream is introduced into another of the at least two process stream passages. As can be appreciated, in case of a nitrogen generator, two process streams can be involved that comprise vaporized coolant from the head condenser or nitrogen product. As such, a main heat exchanger unitized within the present invention as outlined above can function in either an air expansion plant, waste expansion plant or a nitrogen expansion plant.

The present invention provides, in yet another aspect, a method of fabricating an air separation plant with common components to function either with air, product or waste expansion. In accordance with the method an air separation unit is provided having at least one distillation column to separate air into oxygen-rich and nitrogen-rich components and to produce at least two process streams composed of the oxygen and nitrogen-rich components. An expansion means is provided to produce a refrigerant stream to refrigerate the air separation plant. All the air separation plants are fabricated with the main heat exchanger having an air expansion passage to produce a partially cooled air stream, an air liquefaction passage branching off from the air expansion passage to liquefy an air stream, and at least two process stream passages. Each of the at least two process stream passages are sized to accommodate the at least two process streams to column pressure and at a reduced pressure of the refrigerant stream. Additionally provided is a process stream expansion passage configured to partially warm one of the two process streams. In case of air expansion, the expansion machine is connected to the air expansion passage and the process stream expansion passage is not utilized. In case of waste nitrogen expansion the expansion machine is connected to the process stream expansion passage and the air liquefaction passage is not utilized.

In yet still another aspect, the present invention provides a modular distillation column in which at least one section contains at least one bed of structured packing. A liquid distributor is located above the structured packing and comprises a container having a perforate bottom wall to distribute reflux to the structured packing. The container is telescoped within the pipe, in a spaced relationship thereto, so that the vapor passes between the container and the pipe. At least two support members are positioned within the section to hold the at least one bed of structured packing in place. In such manner, sections can be pre-fabricated and connected end to end to form the distillation column.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
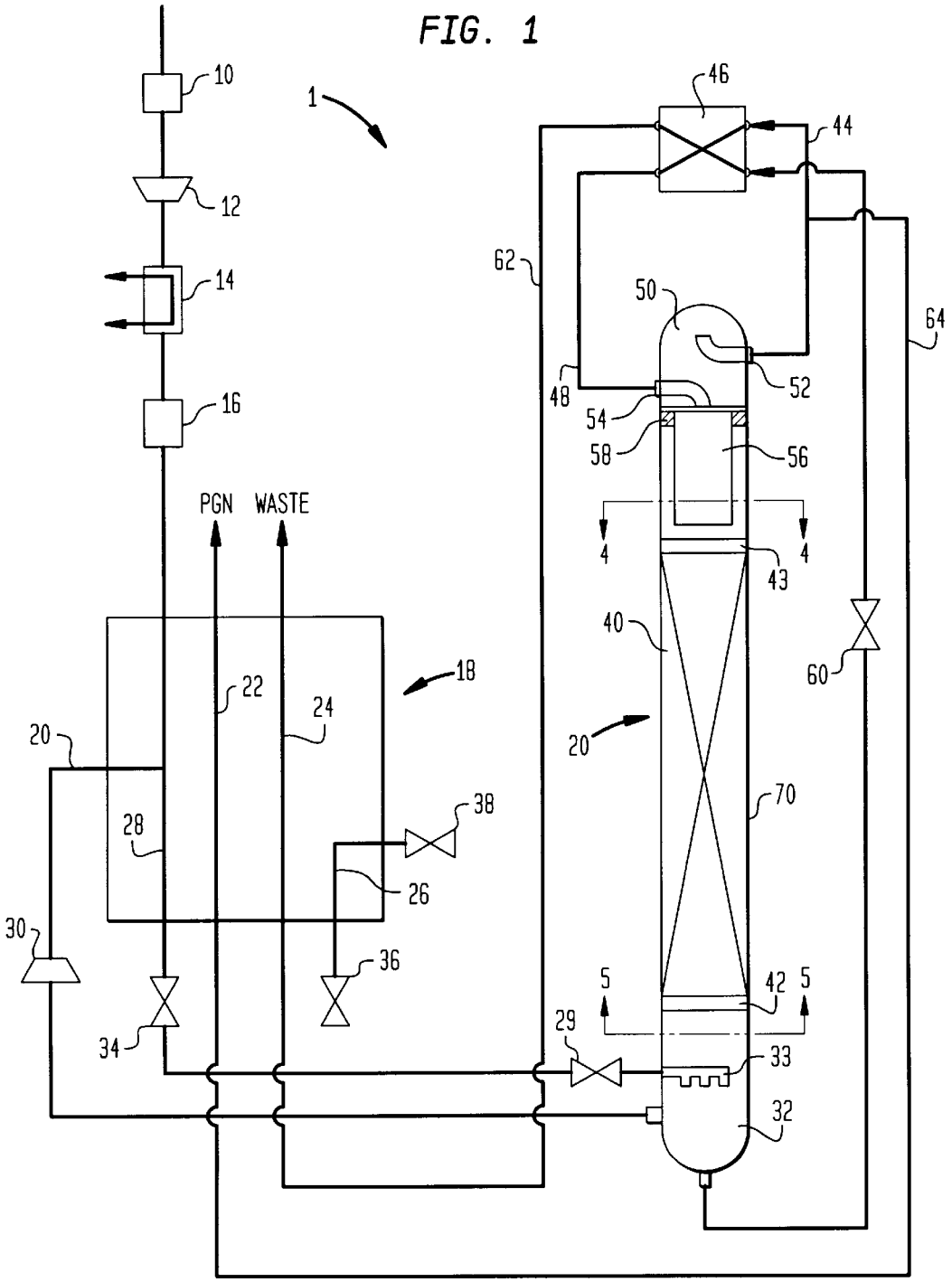
FIG. 1 is a schematic view of an air separation plant in accordance with the present invention.

With reference to the FIG. 1, an air separation plant 1 is illustrated. Air, after having been filtered in a filter 10, is compressed in a compressor 12. After the heat of compression is removed by an aftercooler 14, the air is further purified of moisture, carbon dioxide and other heavier components of the air by a prepurification unit 16. Prepurification unit 16 is preferably a cold trap designed to freeze out moisture and carbon dioxide. The resultant compressed and purified air stream is cooled within a main heat exchanger 18 and is then rectified at low temperature within an air separation unit 20 which is a single column designed to produce an oxygen-rich liquid column bottoms and a nitrogen-rich tower overhead.

Heat exchanger 18 is provided with an air expansion passage 20, two process stream passages 22 and 24 and a process stream expansion passage 26. Main heat exchanger 18 is of plate-fin design and is designed to flnction in a plant that supplies refrigeration by air expansion, product expansion or waste expansion. Further included in heat exchanger 18 is an air liquefaction passage 28.

Air separation plant 1 is designed to function with air expansion and as such, air is partially cooled and discharged from main heat exchanger 18 through air expansion passage 20. It is to be noted, that as used herein and in the claims, the terms "partially cooled" or "partially warmed" mean cooled or warmed (as the context may be) to a temperature between the warm and cold ends of main heat exchanger 18. The partially cooled air stream is expanded within a turboexpansion machine 30 and then introduced into a bottom section 32 of the distillation column 20 by way of an inlet distributor 33. Additionally, a liquefied air stream is produced within air liquefaction passage 28. Such liquefied air stream is reduced in pressure in a valve 29 and is introduced into bottom region 32 of distillation column 20.

As illustrated, a valve 34 is provided to shunt all of the air flow through air expansion passage 20. Additionally, process steam expansion passage 26 left unconnected and thus, is not utilized in the air separation plant 1. To this end, valves 36 and 38 are provided for main heat exchanger 18 in order to isolate process stream expansion passage 26.

The introduction of air into air separation unit 20 produces an ascending vapor phase that is contacted with a descending liquid phase by beds of structured packing 40 mounted on support 42. The descending liquid phase is produced by extracting a reflux stream 44 and condensing the reflux stream within head condenser 46 to form a condensed reflux stream 48 which is introduced into a top region 50 of distillation column 40. Outlet and inlet headers 52 and 54 (pipe elbows) are provided for such purpose. The liquid reflux is fed into a distributor 56 which is telescoped within air separation unit 20 so that a spacing exists between the column wall and liquid distributor 56. An arrangement of spaced blocks 58 connect liquid distributor 56 to the column sidewall of air separation unit 20.

The coolant for head condenser 46 is oxygen enriched liquid which is extracted and expanded within an expansion valve 60. Resultant vaporized coolant stream 62 forms a process stream which is introduced into process stream passage 24 of main heat exchanger 18 where it is fully warmed and is discharged as waste. A product stream 64 composed of the nitrogen component produced within top region 50 of distillation column 20 is also introduced into main heat exchanger 18, within process stream passage 22, where it is thereafter expelled as product gas nitrogen (PGN).

Figure 2:
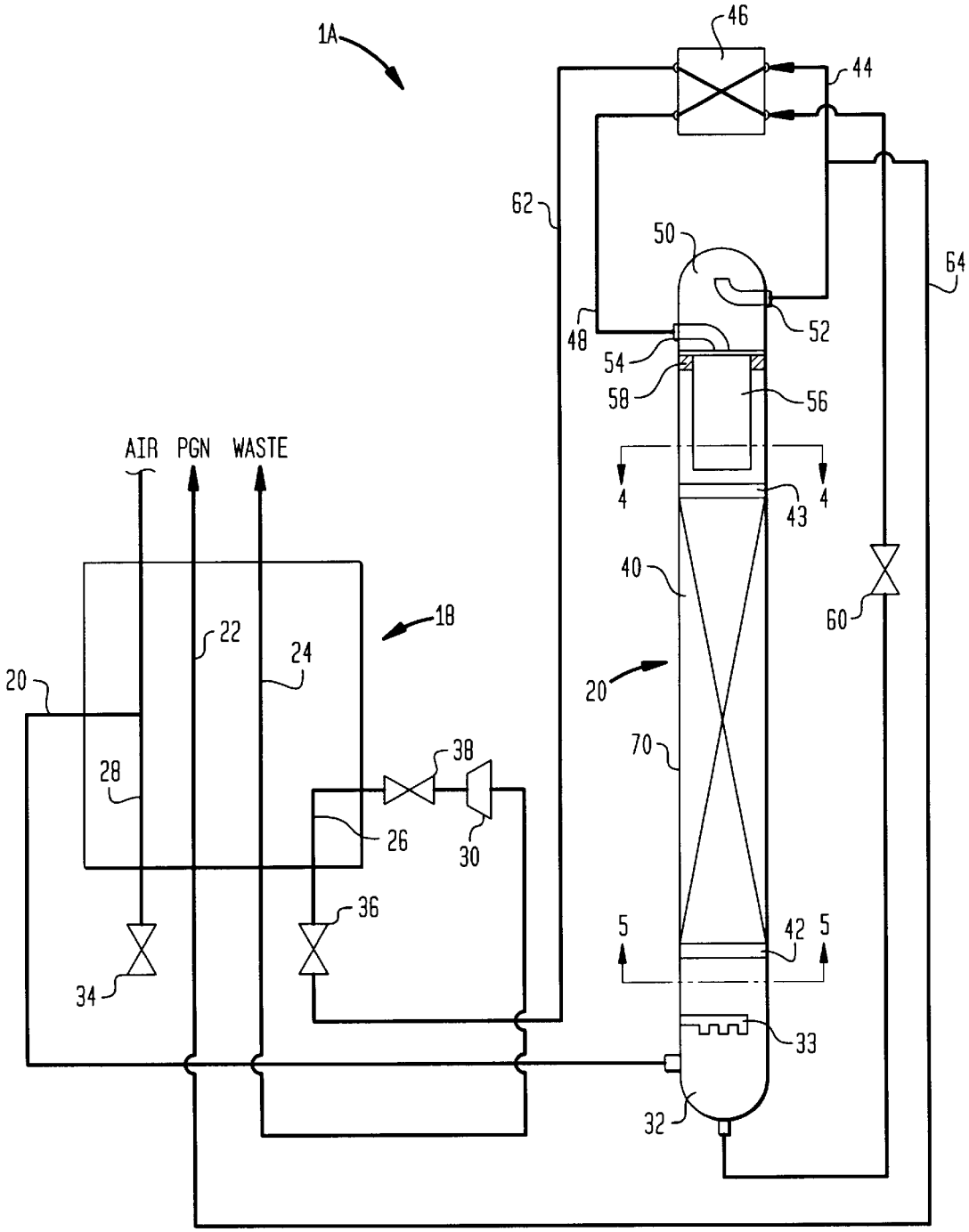
FIG. 2 is an alternative embodiment of an air separation in accordance with the present invention.

FIG. 2 illustrates an air separation plant 1A that contains all of the elements of air separation plant 1 except that main heat exchanger 18 is reconnected so that the plant will now function as a waste expansion plant. As such, vaporized coolant stream 62 is now introduced into process stream expansion passage 26. The vaporized coolant stream 62 after partial warming is introduced into a turboexpander 30 to produce a refrigerant stream. Turboexpander 30 is interposed so that the refrigerant stream is introduced into process stream passageway 24. Valve 34 is in its closed or cut-off position so that all the air flows through air expansion passageway 20 and is introduced as a vapor at or near its dewpoint into bottom region 32 of distillation column 20.

Figure 3:
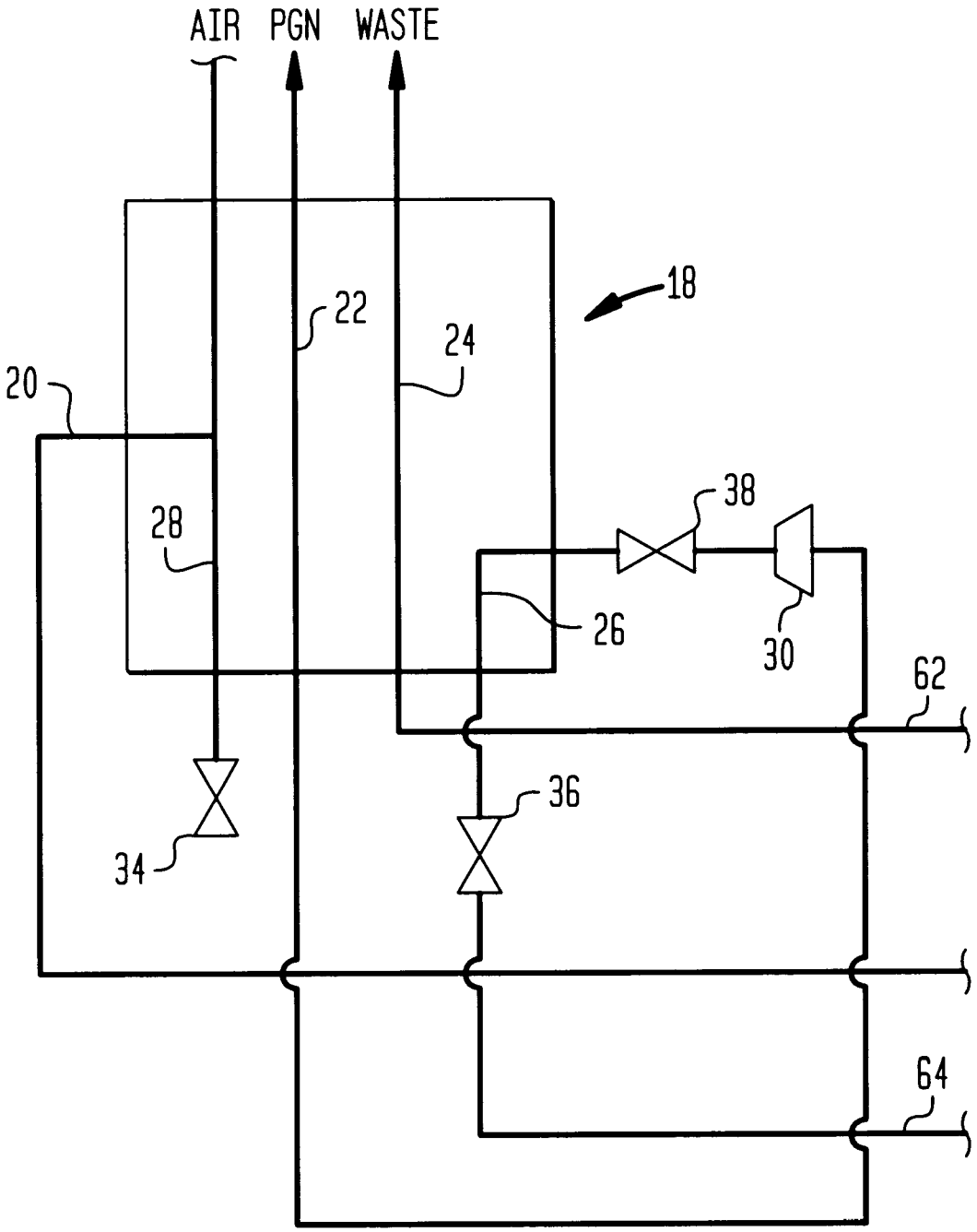
FIG. 3 is fragmentary view of the air separation plant of the type shown in FIG. 2 to illustrate yet still another alternative embodiment of the present invention that encompasses product expansion.

FIG. 3 illustrates the connections in plant 1A that allow alternative operation as a product expansion plant. In such plant, product stream 64 is introduced into process stream expansion passage 26 where it is partially warmed before being introduced into expansion machine 30. Valves 36 and 38 are set in open positions for such purpose. The resultant refrigerant stream is then introduced into process stream passageway 22 where it is expelled as product gas nitrogen. Again, valve 34 is shut and left unconnected so that all of the air flows through air expansion passageway 20. The air at this point is cooled to at or near its dewpoint and it is introduced into bottom region 32 of distillation column 20.

Preferably, distillation column 20 is prefabricated by the use of one or more sections filed with a bed 40 of structured packing. The bed 40 is held in place by supports 42 and 43.

Figure 4:
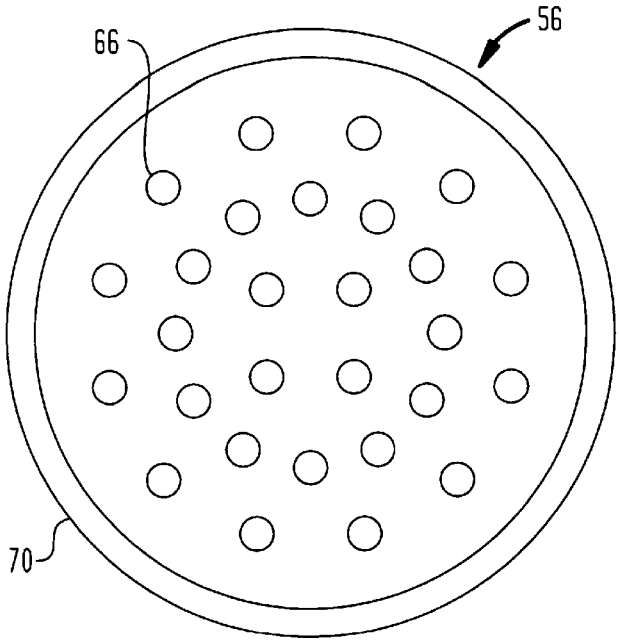
FIG. 4 is a sectional view of FIG. 1 taken along line 4—4 thereof to illustrate the base of a liquid distributor of the present invention.
Figure 5:
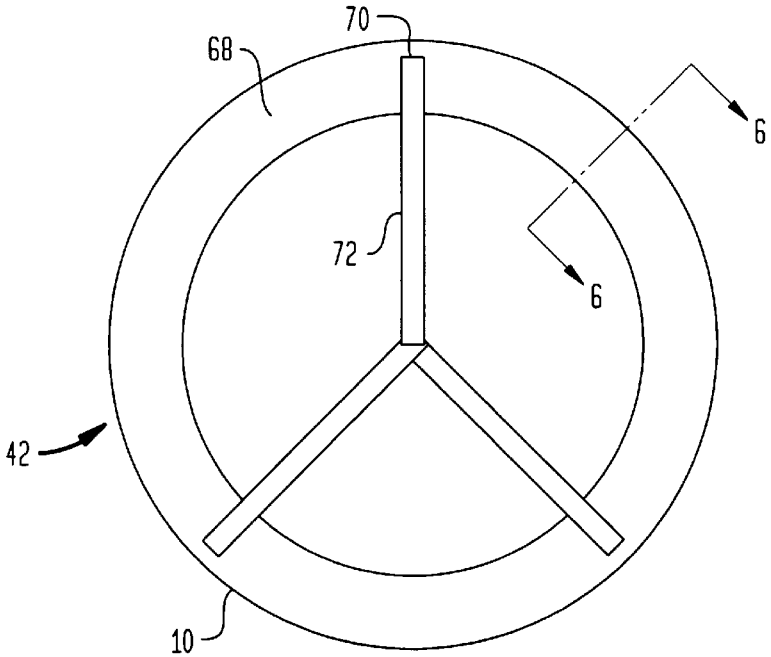
FIG. 5 is a sectional view taken along line 5—5 of FIG. 1 to illustrate a packing support of the present invention.
Figure 6:
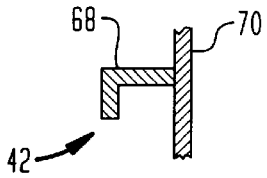
FIG. 6 is a sectional view of FIG. 5 taken along line 6—6 thereof.

Liquid is distributed to the bed 40 of packing by liquid distributor 56 which is simply a cylindrical container. With additional reference to FIG. 4, it can be seen that liquid distributor 56 has a perforate bottom wall 66 from which the liquid is distributed over the packing. As to support 42 (or support 43 for that matter) simplified construction is also employed. With reference to FIGS. 5 and 6, support 42 is formed of an annular member 68 which is connected to column wall 70. The annulus is reinforced by a spider 72. The aforementioned arrangement can be pre-fabricated in a shop and then one or more sections can be used to form the required column. Although the illustrated section has only one bed 40 of packing, more beds could be used depending upon distillation requirements. Since each bed of packing is held in place by support members, such as 42 and 43, the column can be assembled in a fabrication shop and then shipped to the site at which the plant is to be erected without damage to the packing. It is to be noted that although the foregoing arrangement is particularly advantageous, air separation plant 1 could be constructed using a conventional trayed column.

The design of the foregoing described air separation plant 1 allows inexpensive plants to be constructed due to the simplicity of the components. Additionally, heat exchangers such as heat exchanger 18, distillation column sections making up distillation column 20 can be kept on hand for assembly into different air separation plants. Although the present invention has been described with reference to a single column nitrogen generator, the same type of heat exchanger as illustrated by heat exchanger 18 could be used for double column air separation plants. In such case, a condenser reboiler would be placed between column sections. Furthermore, although the main heat exchanger has been described with reference to two process stream passages 22 and 24, it could encompass more process stream passages depending on the product. Thus the reference to two process stream passages herein and in the claims should be taken as a minimum number.

While the present invention has been described with reference to a preferred embodiment, as will occur to those skilled in the art, numerous changes, additions and omissions may be made without departing from the spirit and scope of the present invention.

We claim:

1. An air separation plant comprising:

an air separation unit having at least one distillation column to separate air into oxygen-rich and nitrogen-rich components and to produce at least two process streams composed of the oxygen and nitrogen-rich components;

an expansion machine to produce a refrigerant stream to refrigerate said air separation plant; and a main heat exchanger capable of functioning with air or waste or product expansion refrigerant streams and having an air expansion passage to produce a partially cooled air stream, an air liquefaction passage branching from said air expansion passage to produce a liquefied air stream, at least two process stream passages, each sized to accommodate said at least two process streams at column pressure and at a reduced pressure of said refrigerant stream, and a process stream expansion passage configured to partially warm one of said at least two process streams;

the air expansion passage connected to the expansion machine and the expansion machine connected to said air separation unit that said resultant refrigerant stream is introduced into said air separation unit;

the main heat exchanger connected to the air separation unit to receive said at least two process streams within said at least two process stream passages, to introduce said liquefied air stream into said air separation unit and such that said process stream expansion passage is unconnected and thus, not utilized.

2. An air separation plant comprising:

an air separation unit having at least one distillation column to separate air into oxygen-rich and nitrogen-rich components and to produce at least two process streams composed of the oxygen and nitrogen-rich components;

an expansion machine to produce a refrigerant stream to refrigerate said air separation plant; and a main heat exchanger capable of functioning with air or waste or product expansion refrigerant streams and having an air expansion passage to produce a partially cooled air stream, an air liquefaction passage branching from said air expansion passage to produce a liquefied air stream, at least two process stream passages, each sized to accommodate said at least two process streams at column pressure and at a reduced pressure of said refrigerant stream, and a process stream expansion passage configured to partially warm one of said at least two process streams;

the main heat exchanger connected to the air separation unit so that the one of the at least two process streams is received within the process stream expansion passage and another of said at least two process streams is received within the one of the at least two process stream expansion passages, said partially cooled air stream is introduced into said air separation unit, and said air liquefaction passage is unconnected and thus, not utilized;

the expansion machine connected to the main heat exchanger to receive said one of said at least two process streams after having been partly warmed and so that the refrigerant stream is introduced into another of the at least two process stream passages.

3. The air separation plant of claim 1, wherein:

said air separation unit comprises a single distillation column and a head condenser connected to said single distillation column to produce reflux for said single distillation column;

said head condenser is connected to said single distillation column so that a liquid column bottoms stream composed of said oxygen-rich component is introduced into said head condenser and serves as a coolant to be vaporized and thereby to condense said reflux; and the at least two process streams are formed from said coolant after vaporization thereof; and a vapor phase of said nitrogen-rich component.

4. The air separation plant of claim 2, wherein:

said air separation unit comprises a single distillation column and a head condenser connected to said single distillation column to produce reflux for said single distillation column;

said head condenser is connected to said single distillation column so that a liquid column bottoms stream composed of said oxygen-rich component is introduced into said head condenser and serves as a coolant, thereby to condense said reflux and form said one of said two process streams from said coolant after vaporization thereof; and the another of said two process streams is formed from a vapor phase of said nitrogen-rich component.

5. The air separation plant of claim 2, wherein:

said air separation unit comprises a single distillation column and a head condenser connected to said single distillation column to produce reflux for said single distillation column;

said one of said at least two process streams is formed from a vapor phase of said nitrogen-rich component; and said head condenser is connected to said single distillation column so that a liquid column bottoms stream composed of said oxygen-rich component is introduced into said head condenser and serves as a coolant, thereby to condense said reflux and form said another of said at least two process streams from said coolant after vaporization thereof.

6. The air separation plant of claim 1 or claim 2, wherein said distillation column includes at least one section containing at least one bed of structured packing held in place between support members.

7. The air separation plant of claim 6, wherein said distillation column also includes a liquid distributor located above said structured packing and comprising a container having a perforate bottom wall to distribute said reflux to said structured packing, the container telescoped within the pipe in a spaced relation thereto so that said vapor passes between said container and said pipe.

8. The air separation plant of claim 7, wherein each of said support member comprises an annular member reinforced with a spider-like structure.

9. A method of assembling components in air separation plants to function either with air, product or waste expansion, said method comprising:

providing air separation units, each having at least one distillation column to separate air into oxygen-rich and nitrogen-rich components and to produce at least two process streams composed of the oxygen and nitrogen-rich components;

providing expansion machines to produce refrigerant streams to refrigerate said air plants;

providing main heat exchangers, each having an air expansion passage to produce a partially cooled air stream, an air liquefaction passage branching off from said air expansion passage to liquefy an air stream, at least two process stream passages, each sized to accommodate said at least two process streams at column pressure and at a reduced pressure of said refrigerant stream, and a process stream expansion passage to partially warm one of said two process streams;

in case of said air expansion, connecting the expansion machine to the air expansion and not utilizing said process stream expansion passage;

in case of said waste expansion, connecting the expansion machine to the process stream expansion passage and not utilizing the air liquefaction passage; and in case of product stream expansion connecting the process stream expansion passage to the expansion machine and not utilizing the air liquefaction passage.

10. A modular distillation column comprising:

at least one section formed of a pipe containing at least one bed of structured packing;

a liquid distributor located above said structured packing and comprising a container having a perforate bottom wall to distribute said reflux to said structured packing, the container telescoped within the pipe in a spaced relation thereto so that said vapor passes between said container and said pipe; and at least two support members positioned within said to hold said at one bed of structured packing in place.

11. The distillation column of claim 10, wherein each of said support member comprises an annular member reinforced with a spider-like structure.

* * * * *